US006070649A

United States Patent [19]

Urlau et al.

[11] Patent Number: 6,070,649

[45] Date of Patent: Jun. 6, 2000

[54] METHOD FOR POURING A METAL MELT INTO A MOLD

[75] Inventors: Ulrich Urlau; Wolfgang Reichelt, both of Moers; Ewald Feuerstacke, Dorsten; Wolfgang Döhring, Sonsbeck, all of Germany

[73] Assignee: Mannesmann AG, Düsseldorf, Germany

[21] Appl. No.: 08/913,752

[22] PCT Filed: Mar. 11, 1996

[86] PCT No.: PCT/DE96/00460

§ 371 Date: Oct. 17, 1997

§ 102(e) Date: Oct. 17, 1997

[87] PCT Pub. No.: WO96/29164

PCT Pub. Date: Sep. 26, 1996

[30] Foreign Application Priority Data

Mar. 21, 1995 [DE] Germany ..... 195 12 209

[51] Int. Cl.[7] ..... B22D 11/10; B22D 11/07; B22D 27/15

[52] U.S. Cl. ..... 164/488; 164/63; 164/65; 164/472

[58] Field of Search ..... 164/488, 437, 164/439, 61, 62, 63, 256, 257, 258, 472, 268

[56] References Cited

U.S. PATENT DOCUMENTS 5,547,014 8/1996 Brückner et al. ..... 164/437
5,622,218 4/1997 Pedroza-Contreras ..... 164/418

FOREIGN PATENT DOCUMENTS 5-8035051 5/1983 Japan ..... 164/488

*Primary Examiner*—Harold Y. Pyon
*Assistant Examiner*—I. -H. Lin
*Attorney, Agent, or Firm*—Cohen, Pontani, Lieberman & Pavane

[57] ABSTRACT

Disclosed is a method and apparatus for a metal melt, especially steel, into a vertically oscillating mold via a tundish or intermediate vessel provided with an immersion nozzle to generate endless strands, especially thin strands of steel wherein the intermediate vessel has an open first chamber and a closed second chamber. The metal melt is supplied from the casting ladle to the first open chamber. The second chamber is connected with a vacuum device. An immersion pipe, which projects into the mold and which can be vertically oscillated, is provided in the base of the second chamber.

10 Claims, 3 Drawing Sheets

METHOD FOR POURING A METAL MELT INTO A MOLD

BACKGROUND OF INVENTION

The invention is directed to a method for pouring a metal melt, especially steel, into a vertically oscillating mold via a tundish or intermediate vessel provided with an immersion nozzle to generate endless strands and to an apparatus required for practicing the method for casting metal strands, especially thin slabs of steel, wherein the intermediate vessel has an open first chamber and a closed second chamber. The metal melt is supplied from a casting ladle to the first chamber. The second chamber which is connected with a vacuum device. An immersion pipe, which projects into a mold which can be vertically oscillated, is provided in the base of the second chamber.

EP 0 410 273 discloses a receptacle with a first chamber which is open against atmospheric pressure and which serves to receive molten material and with a second chamber for discharging metal. The second chamber is connected with the first chamber via a wall provided with an opening. The second chamber is sealed and is connected to a vacuum device, so as to adjust a higher metal level in the second chamber than in the first chamber. An outlet, which is only mentioned but not described, and which can be closed by a valve is provided in the second chamber.

DE-OS 2017469 discloses an installation for the continuous casting of molten metal with a continuous casting mold having an intermediate vessel which is sealable in a gastight manner and can be evacuated. A vacuum pressure can be adjusted in the intermediate vessel so as to allow the metal to flow out of the outlet pipe into the mold in an essentially pressureless manner The immersion casting pipe known from this reference is constructed in such a way that the metal jet still penetrates into the liquid pool or crater even when the velocity of the metal flowing out is further reduced by a funnel-shaped construction in the outlet region of the outlet pipe.

The object of the present invention is to provide a method and apparatus which enable the metal melt to be poured into the mold without turbulence and so as to be free of kinetic energy.

SUMMARY OF THE INVENTION

According to the invention, the hydraulic level of the supplied melt is adjusted and the melt exiting the intermediate vessel is supplied isokinetically to the liquid portion of the steel strand. The hydraulic level is adjusted to between 50 to 600 mm above the level of the melt in the mold by applying a vacuum pressure to an intermediate vessel having two chambers to the surface of the melt located in the second chamber, namely in an order of magnitude such that the level of the surface of the melt exposed to the atmosphere in the intermediate vessel is slightly above the level located in the mold.

In another embodiment, the hydraulic level is adjusted in such a way that the amount of melt flowing in is regulated via a closing member and the filament of flow in the immersion pipe always has a positive pressure.

The amount of liquid metal flowing in is adjusted in such a way that it corresponds to the drawn off amount of partially solidified strand. By means of this method, the casting jet, which would otherwise usually occur and which penetrates the liquid strand core, is prevented. In particular, this brings about the advantage that a completely level bath surface results which allows the mold lubricant to be introduced in an exact, uniform manner. Further, the strand shell is solidified in a uniform and undisturbed manner, which not only improves the surface, but also prevents the tendency toward break-out. Further, it is possible to cast strands with a large length-to-width ratio, since no unwanted transverse flow occurs within the mold.

The cross-sectional areas of the immersion pipe and mold are so selected that the annular surface which is openly exposed to the atmosphere has a constant width independent of the level. Steps for influencing the mold lubricant can be carried out in an advantageous manner. In particular, one such step consists in a simple heating of the mold lubricant and a specific metering.

According to the invention, the outlet opening of the immersion pipe has a cross-sectional area which is not less than 0.3 times the inner cross section of the flow cross section of the mold. In order to reduce the thermal stresses in the casing of the immersion pipe, it is preferred that the immersion pipe has rounded corners, specifically to a radius greater than one fourth of the immersion pipe width.

In order to increase reliable supply of mold lubricant, it is preferred that the immersion nozzles are arranged along the inner wall of the mold so as to lean against the latter. The required amount of mold lubricant can be introduced into the bath under pressure at the desired separation point between the mold and the melt.

The mold lubricant can be heated by the heat given off by the molten bath and can also be heated by external energy. Thus, it is suggested to guide a laser beam on the surface in a controllable manner and thus gives off the exact amount of heat energy required.

The immersion pipe according to the invention can be used optionally for round shapes, billets or slabs, for example. It is also particularly suitable for thin slabs with dimensions of, e.g., 60 mm×1,500 mm.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DESCRIPTION OF PREFERRED EMBODIMENT

Figure 1:
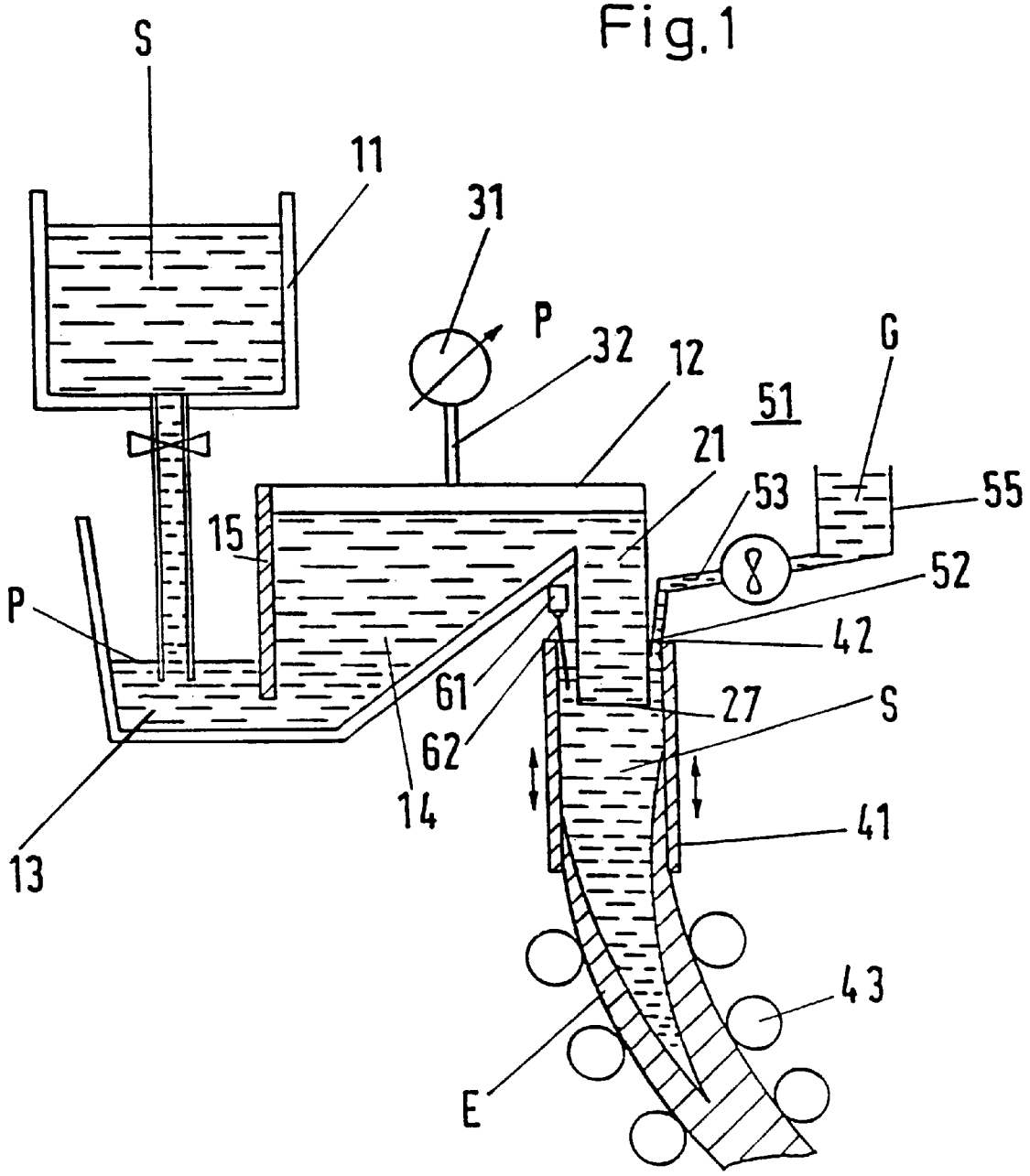
FIG. 1 shows a section through the casting device with a two-chamber vessel.

Referring to FIG. 1, melt S flows out of a casting ladle 11 into a first chamber 13 of an intermediate vessel 12. The first chamber 13 is separated from a second chamber 14 by a dividing wall 15. The second chamber 14 can be closed so as to be gastight and is connected with a pump 31 of a vacuum device via a connection pipe 32. By generating a vacuum, the melt in the chamber 14 is raised to the point that the level $P_{13}$ adjusted in the first chamber 13 lies only slightly above the level $P_{41}$ of the melt in the mold 41. An immersion casting pipe 21 whose outlet opening 27 penetrates into the melt S located in the mold 41 is attached to the second chamber 14.

A mold lubricant G can be supplied via feed line 53 to the annular surface of the melt S in the mold 41, which annular surface communicates with the atmosphere. The feed line 53 is provided with nozzles 52 and leads the lubricant from a mold lubricant receptacle 55 of a mold lubricant supply 51.

Further, thermal energy can be introduced to the surface of the annular surface of the melt S in the mold 41 via its heating device 61, e.g., by means of a laser 62.

The at least partially solidified strand E is transported from the oscillating mold 41 via continuous casting rollers 43.

Figure 2:
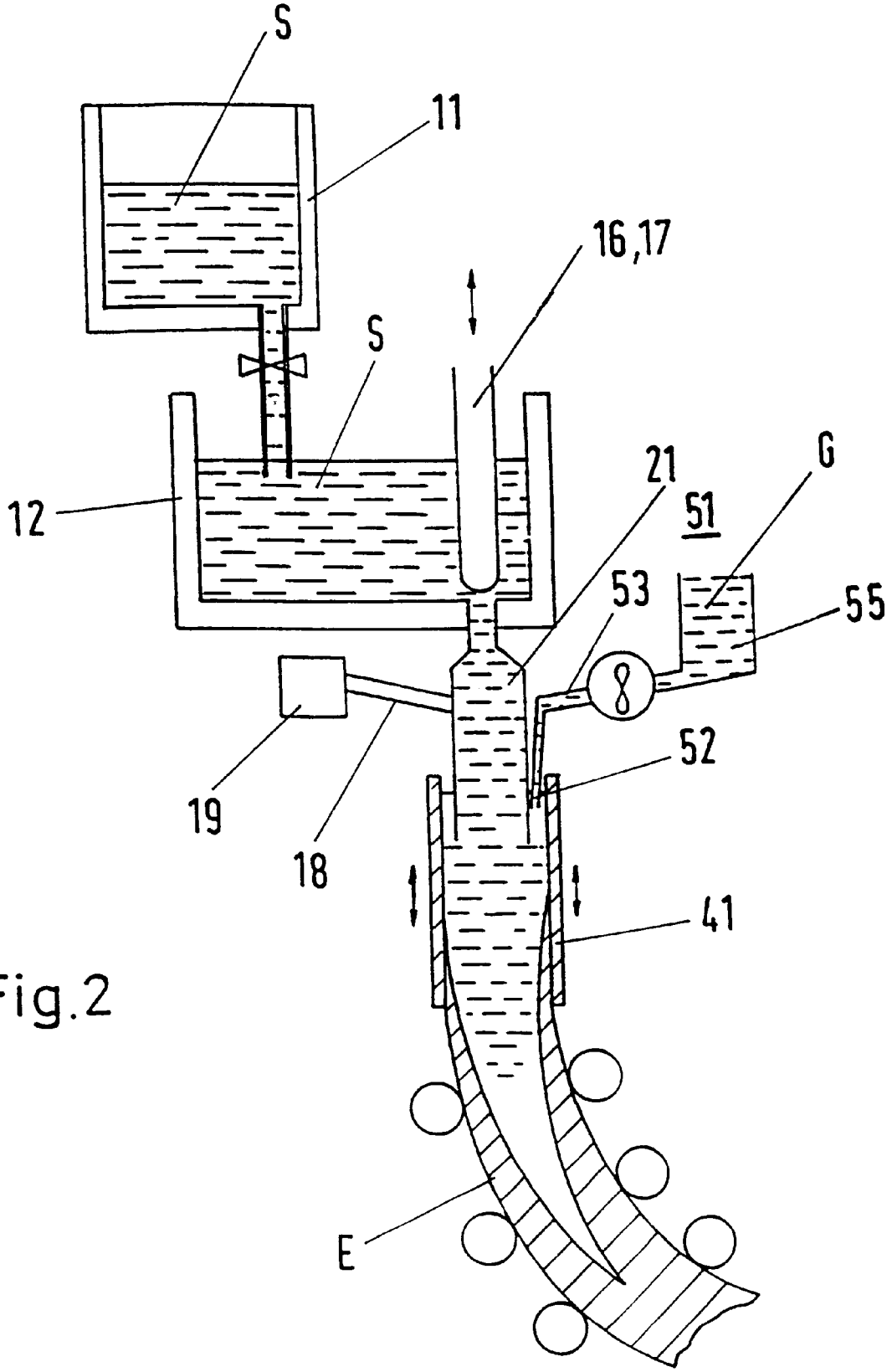
FIG. 2 shows a section through the casting device with an open vessel.

FIG. 2 shows a casting arrangement with a melt supply and a strand discharge identical to those shown in FIG. 1, but with a casting vessel 12 having only one chamber which is open at the top. An immersion pipe 21 is fastened to the base of the casting vessel 12. The inlet opening to the immersion pipe 21 can be blocked by a closing element 16, in this case by a stopper rod 17. The quantity of melt exiting the casting vessel 12 is controlled by vertical adjustment of the stopper rod.

A suction pipe 18 which communicates with a draw-off device 19 is connected to the immersion pipe 21. Influence is exerted on the internal pressure of the immersion pipe 21 by the draw-off device 19, namely, in such a way that the filament of flow of the supplied melt always has a positive pressure.

Figure 3:
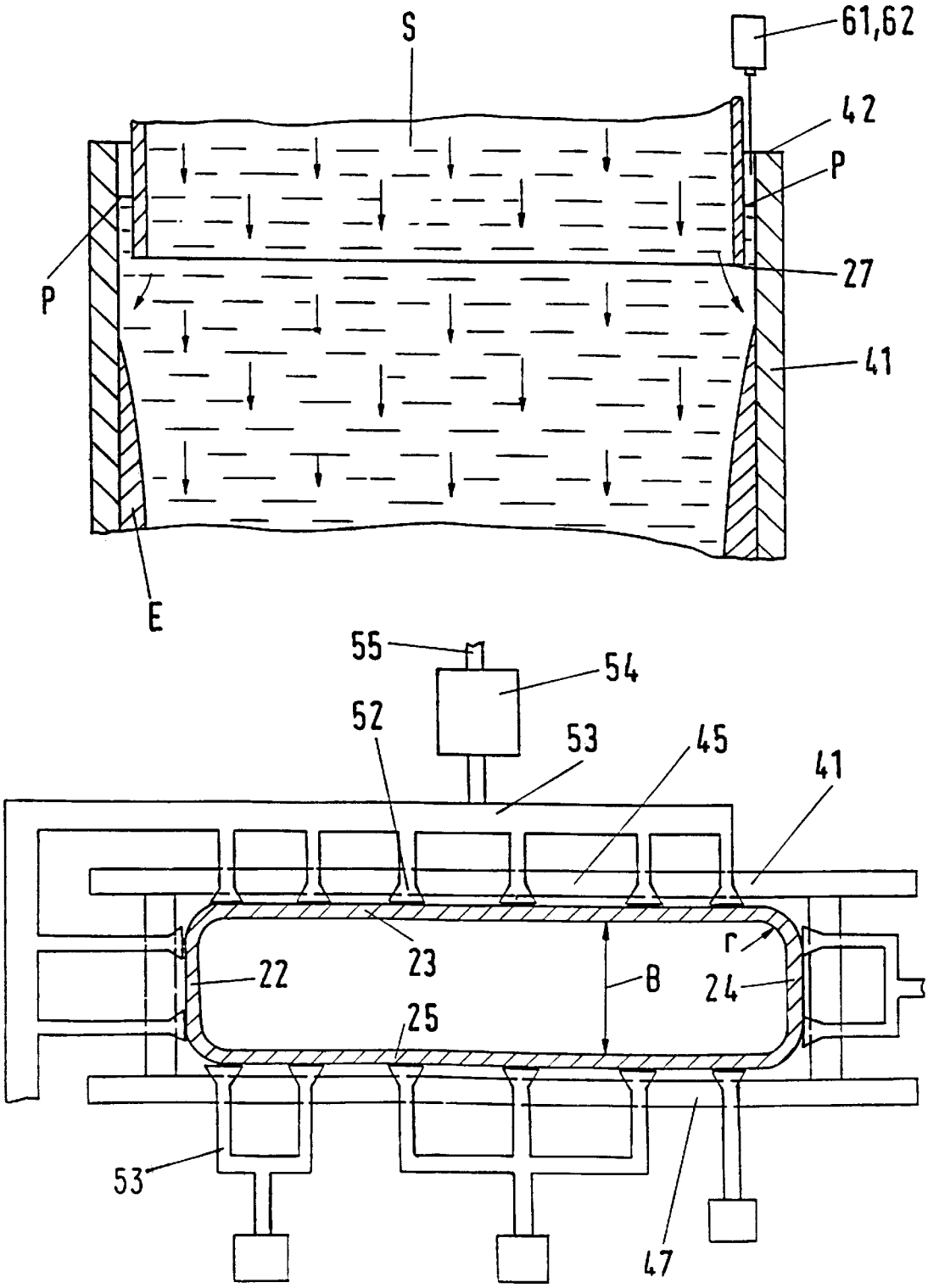
FIG. 3 shows a section and a top view through the immersion casting pipe and the mold.

The upper portion of FIG. 3 shows a section of the immersion pipe 21 whose outlet opening 27 is immersed in the melt S located in the mold 41. Also shown is the gradually forming strand shell of the solidifying strand E. The arrows show the direction and magnitude of the flow velocity of the liquid metal.

Above the upper edge 42 of the mold 41, a mold lubricant G is supplied via nozzles 52 which are arranged at the feed lines 53. Normally, a casting powder is used.

Heat energy is applied by means of a heating device 61, in this case a laser device 62, to the annular surface of the melt S, which annular surface forms between the immersion pipe 21 and the mold 41 and is covered with casting powder.

In the lower part of FIG. 3 is a top view of the mold 41 in section AA. The present case concerns a slab which is formed by the broad sides 44, 46 and the longitudinal sides 45, 47 of the mold 41. The sides 44 to 47 enclose a cross-sectional area $A_K$ of the mold 41.

An immersion pipe 21 penetrates into this inner space by broad sides 22, 24 and longitudinal sides 23, 25 with a free inner surface of $A_T$.

The corners 26 of the immersion pipe 21 are rounded, specifically to a radius r which is greater than one fourth of the width B of the immersion pipe.

Nozzles 52 lead to the annular space formed by the immersion pipe 21 and the mold 41 and are connected via metering devices 54 to mold lubricant receptacles 55 which are not shown in more detail. The metering devices 54 can be connected with different quantities of feed lines 53. Possibilities which include one, two, three and more feed lines 53 are shown.

The invention is not limited by the embodiments described above which are presented as examples only but can be modified in various ways within the scope of protection defined by the appended patent claims.

We claim:

1. A method for adding a metal melt located in a casting receptacle to a melt located in a vertically oscillating mold via an immersion pipe attached to the receptacle and wherein a strand is transported from the mold comprising: adjusting the metal melt to be added to a hydraulic level of between 50 mm and 600 mm higher than that of the melt in the mold; and supplying the melt exiting the casting receptacle isokinetically to a liquid portion of the strand transported from the mold.

2. The method as in claim 1, wherein the casting receptacle which communicates with the mold comprises two chambers and a vacuum is applied for adjusting the hydraulic level of a portion of the melt in the casting receptacle such that the surface level of of the melt exposed to the atmosphere in the casting receptacle lies above the level in the mold.

3. The method as in claim 1, wherein the added melt is supplied in a regulated quantity and is added as a filament of flow under a positive pressure from the start of casting for adjusting the hydraulic level.

4. The method as in claim 1, wherein the melt is added to the interior of the mold through the immersion pipe which has a cross sectional area ($A_T$) which is only slightly less than the cross-sectional area ($A_K$) of the melt located in the interior of the mold.

5. The method as in claim 4, wherein the melt in the mold has an annular surface and is exposed to a free atmosphere and the melt in the mold surrounds the immersion pipe at a constant width independent of the level.

6. The method as in claim 5, wherein a mold lubricant is supplied uniformly to the annulus of melt surrounding the immersion pipe.

7. The method as in claim 6, wherein the mold lubricant is supplied in liquid form.

8. The method as in claim 6, wherein the mold lubricant is heated by external energy.

9. The method as in claim 6, wherein the mold lubricant is added in a regulated amount and under pressure.

10. The method as in claim 1, the metal melt is steel.

* * * * *